US009970163B2

(12) United States Patent
Magalski

(10) Patent No.: US 9,970,163 B2
(45) Date of Patent: May 15, 2018

(54) INFINITELY VARIABLE ECCENTRIC DEVICE FOR VIBRATORY COMPACTOR

(71) Applicant: VOLVO CONSTRUCTION EQUIPMENT AB, Eskilstuna (SE)

(72) Inventor: Edward Magalski, Spring Grove, PA (US)

(73) Assignee: VOLVO CONSTRUCTION EQUIPMENT AB (SE)

( * ) Notice: Subject to any disclaimer, the term of this patent is extended or adjusted under 35 U.S.C. 154(b) by 0 days. days.

(21) Appl. No.: 15/520,190

(22) PCT Filed: Dec. 1, 2014

(86) PCT No.: PCT/US2014/067926

§ 371 (c)(1),
(2) Date: Apr. 19, 2017

(87) PCT Pub. No.: WO2016/089353

PCT Pub. Date: Jun. 9, 2016

(65) Prior Publication Data

US 2017/0306573 A1 Oct. 26, 2017

(51) Int. Cl.

| | |
|---|---|
| ***E01C 19/00*** | (2006.01) |
| ***E01C 19/28*** | (2006.01) |
| ***B06B 1/16*** | (2006.01) |

(52) U.S. Cl.
CPC ..... *E01C 19/286* (2013.01); *B06B 1/162* (2013.01); *E01C 19/281* (2013.01)

(58) Field of Classification Search
CPC ..... E01C 19/286; E01C 19/281; B06B 1/162
(Continued)

(56) References Cited

U.S. PATENT DOCUMENTS 3,385,119 A * 5/1968 Berger ..... B06B 1/166 172/40
3,561,336 A * 2/1971 Century ..... E02D 3/074 404/133.2

(Continued)

FOREIGN PATENT DOCUMENTS

CN 203080389 U 7/2013

OTHER PUBLICATIONS

International Search Report and Written Opinion of International Searching Authority for PCT/US2014/067926, dated Aug. 21, 2015; ISA/KR.

*Primary Examiner* — Raymond W Addie
(74) *Attorney, Agent, or Firm* — Harness, Dickey & Pierce, P.L.C.

(57) ABSTRACT

A vibratory compactor that generates vibrations by rotation of eccentric masses is provided, which includes an inner eccentric rod positioned inside a roller drum of the vibratory compactor and provided with a rack formed on one side of the inner eccentric rod, a pinion engaged with the rack, a variable eccentric weight engaged with the pinion so that a distance between the variable eccentric weight and a rotation axis of the inner eccentric rod is changed as the pinion is rotated, and an outer eccentric tube including a hole formed thereon to guide movement of the rack back and forth and a support fixture formed thereon to fix a shaft of the pinion so that the pinion is rotated in engagement with the rack, wherein when the inner eccentric rod moves back and forth, the pinion that is engaged with the rack is rotated as much as the movement of the rack, and as a position of the variable eccentric weight is changed, an amplitude of vibration of the roller drum is changed.

7 Claims, 7 Drawing Sheets

(58) Field of Classification Search
USPC ..... 404/84.05, 113, 117, 122
See application file for complete search history.

(56) References Cited

U.S. PATENT DOCUMENTS

| | | | | |
|---|---|---|---|---|
| 3,737,244 | A | 6/1973 | Wilson | |
| 4,224,003 | A * | 9/1980 | St. Louis | E02D 3/046 37/904 |
| 4,561,319 | A * | 12/1985 | Lilja | F16C 3/18 404/117 |
| 4,759,659 | A * | 7/1988 | Copie | B06B 1/165 366/125 |
| 5,618,133 | A | 4/1997 | Mitsui et al. | |
| 5,988,939 | A * | 11/1999 | Allen | E01C 19/38 404/113 |
| 6,224,293 | B1 * | 5/2001 | Smith | B06B 1/164 404/117 |
| 6,516,679 | B2 * | 2/2003 | Yates | B06B 1/164 404/117 |
| 8,206,061 | B1 * | 6/2012 | Hansen | E01C 19/286 404/128 |
| 8,393,825 | B2 * | 3/2013 | Marsolek | E01C 19/286 404/117 |
| 2003/0021629 | A1 | 1/2003 | Swanson et al. | |
| 2003/0082003 | A1 | 5/2003 | Potts | |
| 2014/0133909 | A1 * | 5/2014 | Hansen | E01C 19/286 404/117 |
| 2015/0139731 | A1 * | 5/2015 | Persson | F16C 3/18 404/117 |
| 2016/0102438 | A1 * | 4/2016 | Kreische | E02D 3/074 404/117 |

* cited by examiner a - a

INFINITELY VARIABLE ECCENTRIC DEVICE FOR VIBRATORY COMPACTOR

TECHNICAL FIELD

The present disclosure generally relates to a compactor used in the construction of roads, and base compaction of ground conditions for buildings, rail roads, dams and other such earth or stone based structures, and more particularly to a compactor with a vibratory roller having variable amplitude settings.

BACKGROUND OF THE INVENTION

Some vibratory compactors are manufactured with an option of varying the amplitude and frequency of drum vibrations. The amplitude of the vibrations is changed through rotating of a mechanical wheel on the side of a drum. Rotating such a mechanical wheel would change the spacing between eccentric masses on an eccentric shaft inside the drum. The more the masses are aligned on one side of the shaft, the greater an impact force is applied onto the ground and the greater the amplitude of the drum. The more the eccentric masses are symmetrically distributed around the shaft, the less the impact force is applied onto the ground. Usually, the frequency and amplitude are set in pairs to produce a specific amount of force. The produced force is known as an eccentric or centrifugal force that is applied to a surface during compaction. The centrifugal force generated by the rotation of an eccentric weight in the drum of the compactor can be expressed as:

$$F_{ec}=m_{ec}r_{ec}\omega_{ec}^2 \sin(\omega_{ec}t)=A \sin(2\pi ft)$$

where $m_{ec}r_{ec}$ is the moment of the eccentric mass, $\omega_{ec}$ is the angular frequency of rotation, A is the amplitude, and f is the frequency.

There is a strong desire from the market for a means for allowing a vibratory roller to change the amplitude while the compaction machine is operating. However, in order to use two eccentric shaft systems (inner and outer eccentric shafts that move relative to each other to change the amplitude), an operator should get off the compaction machine and manually change the amplitude if more than two amplitude settings are desired. As a result, this inconvenience causes inefficiency and there is a necessity for finding a new way to adjust and manage the variable amplitude setting.

SUMMARY OF THE INVENTION

The compactor, according to the present disclosure, is designed to offer an infinitely variable amplitude eccentric system, which allows an operator of a vibratory compactor (roller) to change the amplitude from an operator's area by providing an input signal, by way of a control knob or other similar means, which drives a means for moving a shaft (inner eccentric rod) back and forth.

The compactor, according to the present disclosure, employs the following arrangement. The compactor, according to the present disclosure, changes an impact force of a compactor by changing the spacing between variable eccentric weights (eccentric masses) on an inner eccentric rod (rotation rod) according to movements of a rack and a pinion inside a roller drum. As the inner eccentric rod moves back and forth, the rack which is attached thereto will drive the pinion which will raise or lower the variable eccentric weight relative to the axis of rotation, thus changing the amplitude and impact force.

The movement of the inner eccentric rod can be performed either by an electromagnetic field, electric actuator, or a hydraulic actuator.

If an operator can vary the amplitude of vibration of the roller without getting off the machine, it will offer convenience to the operator and have the machine change all of its operating parameters without any physical human intervention.

Further, through improvement of a structure that is complicated to adjust the amplitude in the roller drum, the amplitude of vibration generated by roller drum can be adjusted by changing the position of eccentric masses in the roller drum with a simplified mechanical operation.

DETAILED DESCRIPTION OF THE INVENTION

The foregoing description of the embodiments of the present disclosure has been presented for the purpose of illustration, but it is not intended to be exhaustive or to limit the present disclosure to the precise forms disclosed. Persons skilled in the related art can appreciate that many modifications and variations are possible in light of the above teachings. It is therefore intended that the scope of the invention be limited not by this detailed description, but rather by the claims appended hereto.

As described above in the background art, a rotating roller drum of a compactor can change an impact force according to an eccentric mass, angular frequency of rotation, amplitude, and frequency. Among them, the amplitude of the roller drum may be differently set according to the position of the eccentric mass positioned in the roller drum, and as a result, this may exert an influence on the compaction force of the compactor. This compactor may also be called a vibratory compactor. The vibratory compactor according to the present disclosure is provided with a variable eccentric device in the roller drum, which enables an operator to easily change the amplitude of vibration that is generated by the roller drum.

Figure 1:
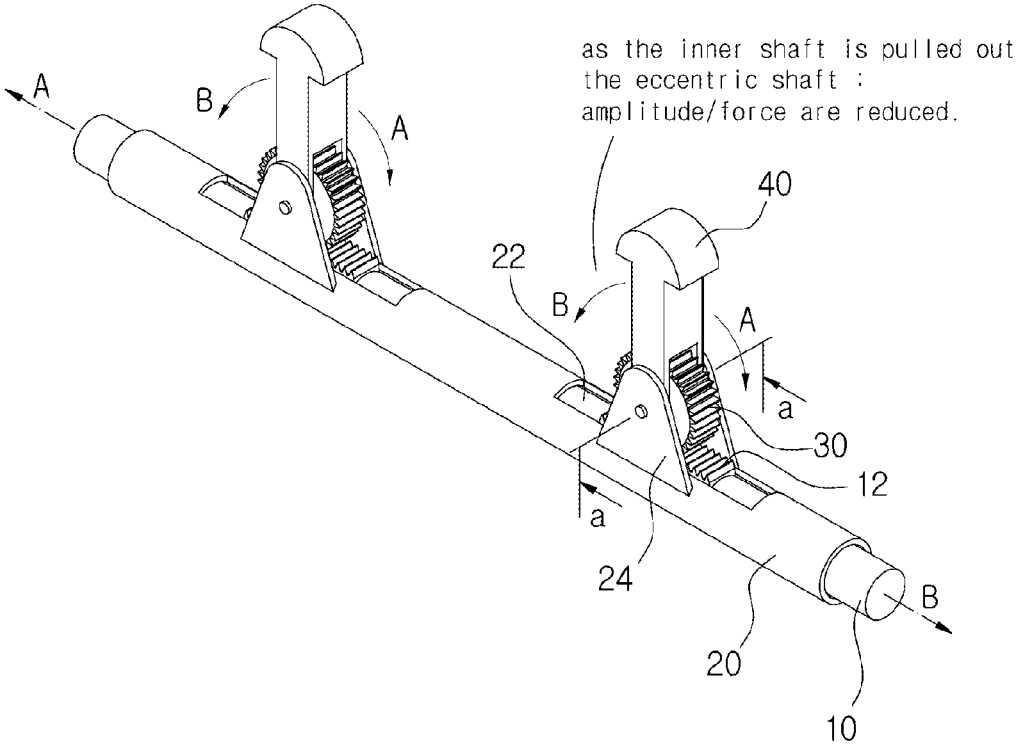
FIG. 1 is a first schematic view of a variable eccentric device in a roller drum according to an embodiment of the present disclosure.
Figure 2:
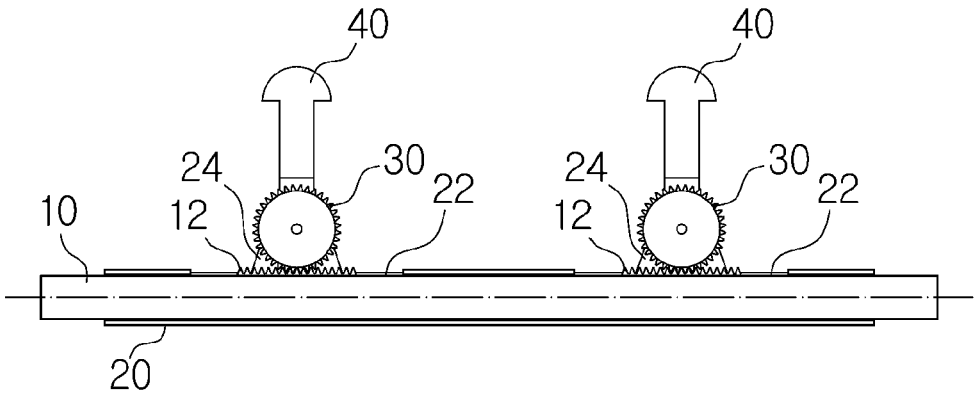
FIG. 2 is a first cross-sectional view of a variable eccentric device in a roller drum according to an embodiment of the present disclosure.

FIG. 1 is a first schematic view of a variable eccentric device in a roller drum according to an embodiment of the present disclosure, and FIG. 2 is a first cross-sectional view of a variable eccentric device in a roller drum according to an embodiment of the present disclosure.

Referring to FIG. 1, a variable eccentric device according to the present disclosure include an inner eccentric rod 10 that is positioned inside a roller drum of a vibratory compactor, and a rack 12 is formed on one side of the inner eccentric rod. The inner eccentric rod is rotated about a rotation axis to generate a centrifugal force in a vibratory roller, and the generated centrifugal force increases an impact force that hardens the ground. The rack 12 that is formed on the inner eccentric rod is engaged with a pinion 30 to be described later, and serves to change the position of a variable eccentric weight 40. The length of the rack, the number of saw teeth, and the size of the saw teeth may be determined to correspond to the number of saw teeth and the size of the saw teeth of the pinion.

In FIG. 1, directions A and B are directions in which the inner eccentric rod can move. The inner eccentric rod may be rotated about the rotation axis and move in the either directions A or B. The linear motion of the rod in the directions A and B (back and forth) is made separately from the rotating motion, and changes the position of the rack.

At present, as shown in FIG. 1, the variable eccentric weight is at right angles to the inner eccentric rod, and the weight center of the variable eccentric weight is farthest apart from the inner eccentric rod. If the inner eccentric rod is moved along the rotational axis, the variable eccentric weight that is at right angles to the inner eccentric rod is rotated to generate the maximum centrifugal force.

According to the variable eccentric device, according to the present disclosure, the inner eccentric rod includes the pinion 30 that is engaged with the rack 12. The pinion is engaged with the rack 12 that is formed on the inner eccentric rod and serves to move the position of the variable eccentric weight 40. The number of saw teeth and the size of the saw teeth of the pinion 30 may be determined to correspond to the number of saw teeth and the size of the saw teeth of the rack.

The variable eccentric device according to the present disclosure includes the variable eccentric weight 40 that is engaged with the pinion 30. As the pinion 30 is rotated, the distance between the weights 40 and the rotation axis of the inner eccentric rod is changed. The variable eccentric weight plays an important role of generating the centrifugal force when the inner eccentric rod is moved linearly, and are particularly related to the amplitude among elements that determine the level of the centrifugal force.

The variable eccentric device according to the present disclosure includes an outer eccentric tube 20, on which a hole 22 for guiding so that the rack can move back and forth and a support fixture 24 for fixing the shaft of the pinion so that the pinion 30 can be rotated in engagement with the rack are formed.

It is preferable that the hole formed on the outer eccentric tube has a width that corresponds to the width of the rack so that when the inner eccentric rod moves in the directions A and B, the rack can rotate the pinion in a state where the rack does not secede from the pinion. If the width of the hole is too wide, the rack may be shaken from side to side when the inner eccentric rod moves in the directions A and B, and the engagement between the rack and the pinion may become mismatched.

Further, it is preferable that the hold has a length whereby the rack does not secede from the pinion and maintains the engagement with the pinion in a state where the pinion is maximally rotated when the inner eccentric rod moves in the directions A and B to change the position of the variable eccentric weight, that is, in a state where the variable eccentric weight is maximally tilted in the directions A and B and are put in a position that is most adjacent to the rotation axis of the inner eccentric rod. If the hole of the outer eccentric tube is formed too long, the rack and the pinion may be disengaged from each other when the inner eccentric rod excessively moves in the directions A and B, and thus the eccentric body may not be fixed but may move arbitrarily.

Accordingly, referring to FIG. 1, it is preferable that the hole that is formed on the outer eccentric tube is formed in the form of a rectangle having a width and a length enough to guide the movement of the rack.

The support fixture that is formed on the outer eccentric tube serves to fix the shaft of the pinion so that the pinion is rotated in engagement with the rack. When the inner eccentric rod is moved linearly, the variable eccentric weight and the pinion are rotated in a state where the variable eccentric weight and the pinion are engaged with and fixed to the rack, and thus it is preferable that the support fixture has a sufficient strength to endure the centrifugal force when the variable eccentric weight and the pinion are rotated. Further, the support fixture may include a pinion spindle that fixes the shaft of the pinion so that the pinion can be rotated in engagement with the rack. The pinion spindle fixes the position of the pinion shaft and enables the pinion to perform rotating motion when the rack performs linear motion in the directions A and B, changing the position of the variable eccentric weight engaged with the pinion. As a result, the linear motion of the rack is shifted to a continuous circular motion of the variable eccentric weight.

As a result, according to the variable eccentric device, according to the present disclosure, when the inner eccentric rod moves back and forth (in the directions A and B in FIG. 1), the pinion that is engaged with the rack is rotated as much as the movement of the rack, and the position of the variable eccentric weight is changed as much as the rotation of the pinion. As the position of the variable eccentric weight is changed, the amplitude of the vibration of the vibratory compactor is changed.

Figure 3:
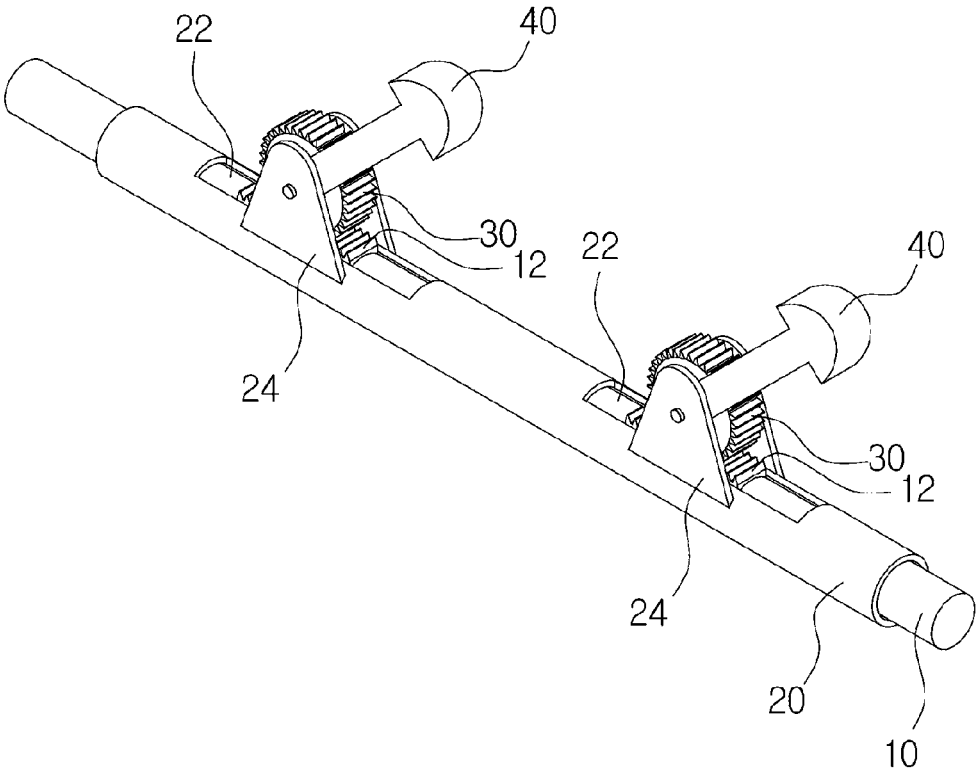
FIG. 3 is a second schematic view of a variable eccentric device in a roller drum according to another embodiment of the present disclosure.
Figure 4:
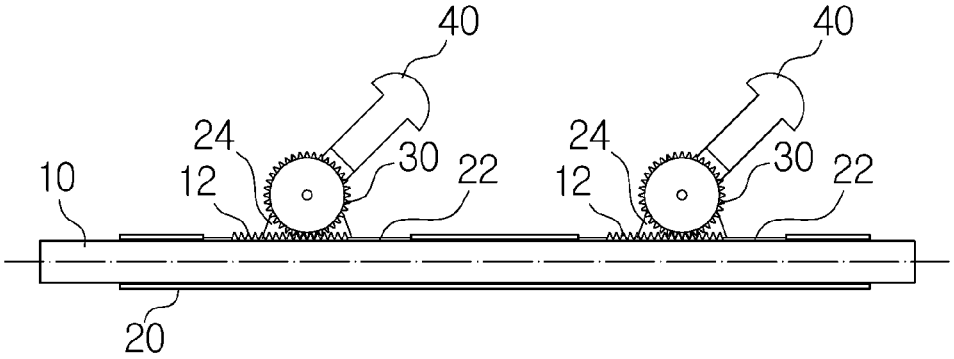
FIG. 4 is a second cross-sectional view of a variable eccentric device in a roller drum according to another embodiment of the present disclosure.

FIG. 3 is a second schematic view of a variable eccentric device in a roller drum according to another embodiment of the present disclosure, and FIG. 4 is a second cross-sectional view of a variable eccentric device in a roller drum according to another embodiment of the present disclosure.

Referring to FIGS. 3 and 4, unlike that illustrated in FIGS. 1 and 2, the inner eccentric rod moves in the direction A and the variable eccentric weight is tilted at an angle of 45° with the rotation axis of the inner eccentric rod. The rack of the inner eccentric rod moves along the hole of the outer eccentric tube as long as the distance that the inner eccentric rod moves, and the pinion is rotated in proportion to the movement distance of the rack. Accordingly, the variable eccentric weight becomes closer to the rotation axis of the inner eccentric rod, and the variable eccentric device illustrated in FIGS. 3 and 4 generates the amplitude that is changed from the amplitude of the variable eccentric device illustrated in FIGS. 1 and 2.

Figure 5:
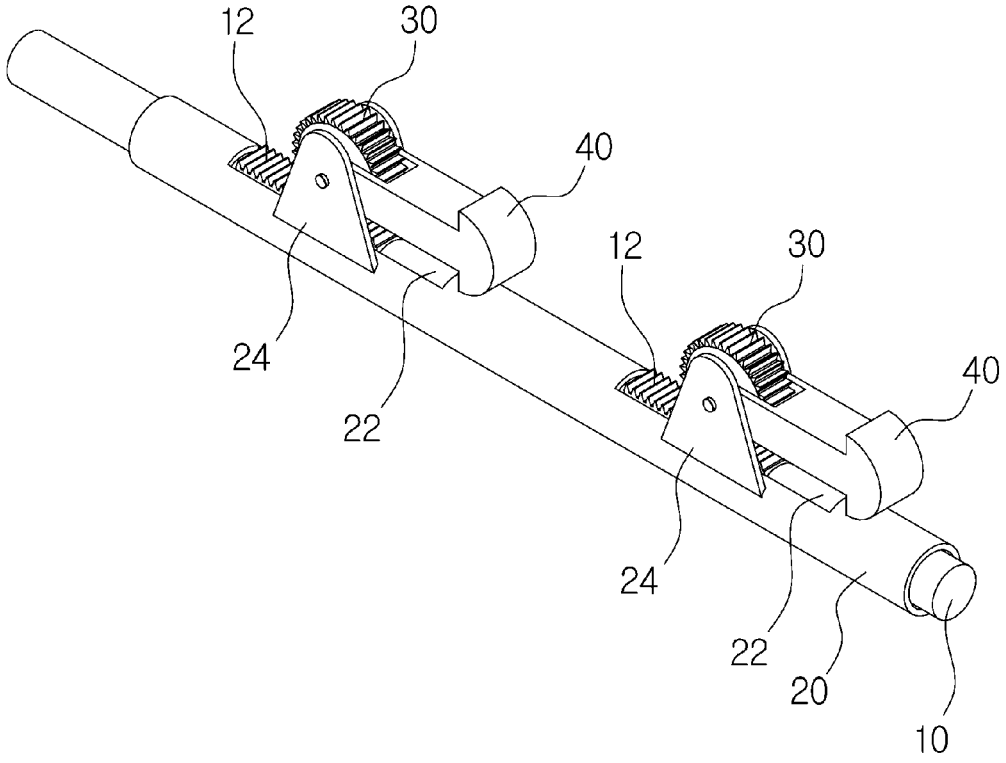
FIG. 5 is a third schematic view of a variable eccentric device in a roller drum according to still another embodiment of the present disclosure.
Figure 6:
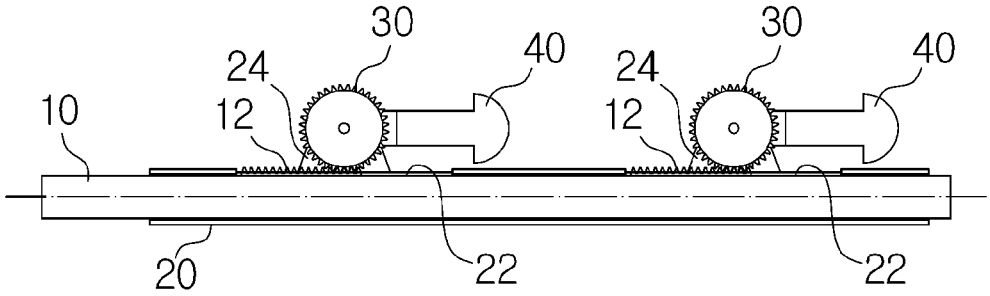
FIG. 6 is a third cross-sectional view of a variable eccentric device in a roller drum according to still another embodiment of the present disclosure.

FIG. 5 is a third schematic view of a variable eccentric device in a roller drum according to still another embodiment of the present disclosure, and FIG. 6 is a third cross-sectional view of a variable eccentric device in a roller drum according to still another embodiment of the present disclosure.

Referring to FIGS. 5 and 6, as compared with that illustrated in FIGS. 3 and 4, the inner eccentric rod further moves in the direction A and the variable eccentric weight is tilted to be almost in parallel to the rotation axis of the inner eccentric rod. The rack of the inner eccentric rod moves along the hole of the outer eccentric tube as long as the distance that the inner eccentric rod moves, and the pinion is rotated in proportion to the movement distance of the rack. In this case, the hole of the outer eccentric tube guides the movement of the rack, and as described above, the hold has the length whereby the rack does not secede from the pinion in a state where the variable eccentric weight becomes closest to the rotation axis of the inner eccentric rod.

As the pinion is rotated, the variable eccentric weight becomes closer to the rotation axis of the inner eccentric rod, and the variable eccentric device illustrated in FIGS. 5 and 6 is rotated to generate the amplitude which is changed from the amplitude of the variable eccentric device illustrated in FIGS. 3 and 4 and which is further changed from the amplitude of the variable eccentric device illustrated in FIGS. 1 and 2.

Figure 7:
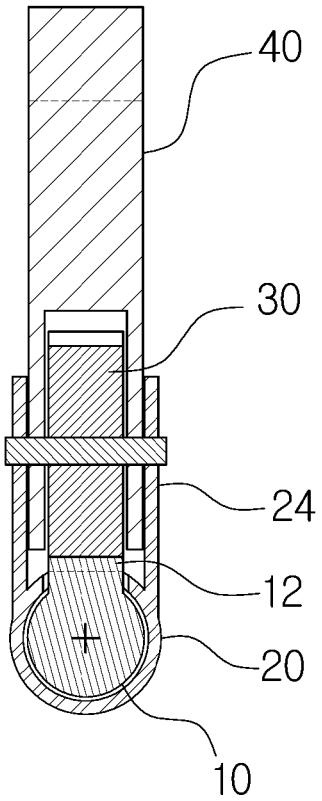
FIG. 7 is a cross-sectional view of a variable eccentric device in a roller drum taken along line a-a in FIG. 7.

FIG. 7 is a cross-sectional view of a variable eccentric device in a roller drum taken along line a-a in FIG. 7. FIG. 7 shows a cross-section of the variable eccentric device according to the present disclosure as seen from the axis direction of the inner eccentric rod. Referring to FIG. 7, the engagement state between the rack of the inner eccentric rod and the pinion and the connection relationship between the pinion, the variable eccentric weight, and the support fixture of the outer eccentric tube can be confirmed.

Since it is necessary for the inner eccentric rod of the variable eccentric device according to the present disclosure to simultaneously perform the rotating motion and the linear motion, the inner eccentric rod requires driving forces for the respective motions. In a case of the rotating motion of the inner eccentric rod, the corresponding driving force can be supplied according to the related art, but in a case of the linear motion, a separate driving force may be required.

The inner eccentric rod may move back and forth (in the directions A and B) by at least one of an electromagnetic field, an electric actuator, or a hydraulic actuator. The inner eccentric rod may be driven by a driving force that moves the roller drum of the vibratory compactor (or by an auxiliary driving force that is derived from the driving force that moves the roller drum) according to an embodiment, or by a driving power supply separately provided according to another embodiment.

In still another embodiment, the variable eccentric weight may be integrally formed with the pinion. In this case, the rotating angle of the pinion may coincide with the rotating angle of the variable eccentric weight.

In still another embodiment, the variable eccentric weight may include a lower end portion that is composed of a connection portion with the pinion and an upper end portion that is composed of a weight, and the weight center of the variable eccentric weight may be positioned to be tilted toward the upper end portion. For example, the variable eccentric weight of FIG. 1 is designed so that the lower end portion that is connected to the pinion is in the shape of a thin bar and the upper end portion has a larger weight than the weight of the lower end portion. The position of the weight center of the variable eccentric weight may be adjusted to meet the conditions required by the respective vibratory compactors.

In still another embodiment, if the rack moves to maximally rotate the pinion, the variable eccentric weight may be put most adjacent to the rotation axis of the inner eccentric rod. In this case, it is general that the amplitude of the centrifugal force that is generated according to the rotation of the inner eccentric rod may be decreased.

In still another embodiment, if the rack moves to make the variable eccentric weight at right angles to the inner eccentric rod, the weight center of the variable eccentric weight may be positioned to be farthest apart from the inner eccentric rod. In this case, it is general that the amplitude of the centrifugal force that is generated according to the rotation of the variable eccentric rod may be increased.

In still another embodiment, the variable eccentric device according to the present disclosure may include a plurality of racks of the variable eccentric rod, variable eccentric weights, holes of the outer eccentric tube, and support fixtures. Exemplarily, the variable eccentric device illustrated in FIGS. 1 to 7 includes two pairs of racks, pinions, variable eccentric weights, holes of the outer eccentric tube, and support fixtures, respectively. If the variable eccentric device according to the present disclosure is provided with one variable eccentric weight, the weight of the variable eccentric weight should be increased to generate a sufficient centrifugal force. However, if several pairs of variable eccentric weights are provided in one inner eccentric rod, the weight of each variable eccentric weight can be lowered, and as a result, the durability of the support fixtures of the outer eccentric tube that support the variable eccentric weights and the pinions can be maintained long.

As described above, if the variable eccentric device is provided in the roller drum of the vibratory compactor, the operator can change the amplitude of the vibration that is generated by the roller drum of the compactor in the work space without getting off the compactor, and thus the work efficiency can be increased.

The invention claimed is:

1. A vibratory compactor that generates vibrations by rotation of eccentric masses, comprising:

an inner eccentric rod positioned inside a roller drum of the vibratory compactor and provided with a rack formed on one side of the inner eccentric rod;

a pinion engaged with the rack;

a variable eccentric weight engaged with the pinion so that a distance between the variable eccentric weight and a rotation axis of the inner eccentric rod is changed as the pinion is rotated; and an outer eccentric tube including a hole for guiding movement of the rack back and forth and a support fixture for fixing a shaft of the pinion so that the pinion is rotated in engagement with the rack, wherein when the inner eccentric rod moves back and forth, the pinion that is engaged with the rack is rotated as much as the movement of the rack, and as a position of the variable eccentric weight is changed, an amplitude of vibration of the roller drum is changed.

2. The vibratory compactor according to claim 1, wherein the variable eccentric weight is integrally formed with the pinion.

3. The vibratory compactor according to claim 1, wherein the inner eccentric rod moves back and forth using any one of an electromagnetic field, an electric actuator, and a hydraulic actuator.

4. The vibratory compactor according to claim 1, wherein a plurality of racks of the inner eccentric rod, a plurality of variable eccentric weights, and a plurality of holes of the outer eccentric tube are provided.

5. The vibratory compactor according to claim 1, wherein the variable eccentric weight comprises a lower end portion that is composed of a connection portion to the pinion and an upper end portion that is composed of a weight, and a weight center of the variable eccentric weight is positioned to be tilted toward the upper end portion.

6. The vibratory compactor according to claim 5, wherein if the rack moves to maximally rotate the pinion, the variable eccentric weight is put to be most adjacent to the rotation axis of the inner eccentric rod.

7. The vibratory compactor according to claim 5, wherein if the rack moves and the variable eccentric weight becomes at right angles to the inner eccentric rod, the weight center of the variable eccentric weight is positioned to be farthest apart from the rotation axis of the inner eccentric rod.

* * * * *